US006141512A

United States Patent [19]

Nagano et al.

[11] Patent Number: 6,141,512

[45] Date of Patent: Oct. 31, 2000

[54] PROCESS CARTRIDGE HAVING AIR FLOW PATH

[75] Inventors: Toshiyuki Nagano, Kawasaki; Kazuaki Teshima, Hoya, both of Japan

[73] Assignee: Canon Kabushiki Kaisha, Tokyo, Japan

[21] Appl. No.: 09/339,374

[22] Filed: Jun. 24, 1999

[30] Foreign Application Priority Data

Jun. 30, 1998 [JP] Japan ..... 10-183881
Oct. 30, 1998 [JP] Japan ..... 10-310792

[51] Int. Cl.[7] ..... G03G 21/20

[52] U.S. Cl. ..... 399/92

[58] Field of Search ..... 399/92, 107, 111, 399/320, 113, 122; 355/30

[56] References Cited

U.S. PATENT DOCUMENTS

| | | | |
|---|---|---|---|
| 4,540,268 | 9/1985 | Toyono et al | 399/93 |
| 4,693,588 | 9/1987 | Yarbrough et al. | 399/93 |
| 4,891,678 | 1/1990 | Ishizu et al. | 399/91 |
| 5,307,132 | 4/1994 | Tsuchiya | 399/70 |
| 5,471,280 | 11/1995 | Taguchi | 399/330 |
| 5,479,242 | 12/1995 | Sato et al. . | |
| 5,878,304 | 3/1999 | Watanabe et al. | 399/92 |

FOREIGN PATENT DOCUMENTS

| | | |
|---|---|---|
| 0 549 089 | 6/1993 | European Pat. Off. . |
| 0 556 975 | 8/1993 | European Pat. Off. . |
| 62-138862 | 6/1987 | Japan . |
| 02-034867 | 2/1990 | Japan . |
| 05-232775 | 9/1993 | Japan . |

OTHER PUBLICATIONS

Patent Abstracts of Japan, vol. 1997, published Aug. 29, 1997, English Abstract of JP 09–106239.

*Primary Examiner*—Robert Beatty
*Attorney, Agent, or Firm*—Fitzpatrick, Cella, Harper & Scinto

[57] ABSTRACT

A process cartridge detachably mounted to an image forming apparatus includes a frame, an image bearing member, a cleaning portion provided between the frame and the image bearing member, an inner wall provided between the frame and the cleaning portion, a first opening portion provided between the frame and the inner wall at an upper part of the process cartridge, and a second opening portion provided between the frame and the inner wall at a lower part of the process cartridge. A cartidge air flow will be created by moving air from the second to the first openings. In addition, a main body air flow is created adjacent the cartidge air flow.

19 Claims, 4 Drawing Sheets

PROCESS CARTRIDGE HAVING AIR FLOW PATH

BACKGROUND OF THE INVENTION

1. Field of the Invention

The present invention relates to an image forming apparatus such as a copying machine, a printer and the like, and a process cartridge used in such an image forming apparatus.

2. Related Background Art

Nowadays, electrophotographic image forming apparatuses are widely used as copying machines, printers and the like, and, in such an image forming apparatus, an electrostatic image formed on a photosensitive member (image bearing member) is developed by a developing device as a toner image which is in turn transferred onto a transfer material and then is fixed to the transfer material, thereby obtaining an image.

For example, in such an apparatus, as shown in FIG. 4, a toner image formed on a photosensitive drum (photosensitive member) 51 is transferred, by a transfer charger (transfer means) 52, onto a transfer material S sent from a convey means 50, and then, the transfer material is conveyed, by a convey belt 53, to a fixing means 54, where the toner image is thermally fixed to the transfer material. Thereafter, the transfer material is discharged onto a discharge tray 55.

A flow of air within the apparatus includes an air flow directed toward a direction shown by the arrows P from above a charger (charge means) 56 and a developing device (developing means) 57, and an air flow directed from the transfer charger 52 toward a direction shown by the arrow R and forcibly directed by a suction fan 58 provided at the convey belt 53 toward a direction shown by the arrows Q and then toward a direction shown by the arrows S to be discharged out of the apparatus rearwardly.

The convey belt is elongated in a left-and-right direction and is greater than a space Y between the fixing means 54 and a cleaning means 59 (for removing and collecting residual toner on the photosensitive drum 51 after the toner image was transferred), and level of increase in temperature of an outer wall 59*a* of the cleaning means 59 causes no problem, and heat from the fixing means 54 does not heat toner and a cleaning blade in the cleaning means 59 excessively so as to cause any problem. Thus, in such an apparatus, any air flow was not passed through the space Y.

However, in the above-mentioned image forming apparatus, when the conveying distance of the convey belt 53 is decreased in order to make the apparatus more compact, the cleaning means 59 storing the toner collected from the photosensitive drum 51 approaches to a greater extent the fixing means 54, with the result that the temperature of the cleaning means 59 is increased by the heat from the fixing means 54 so that blocking of the collected toner may be generated.

SUMMARY OF THE INVENTION

An object of the present invention is to provide an image forming apparatus in which, even when the apparatus is made more compact, an increase in temperature within the apparatus can be suppressed, and a process cartridge used in such an image forming apparatus.

Another object of the present invention is to provide an image forming apparatus in which image formation can be effected stably by preventing the temperature of a cleaning portion from increasing by heat from a fixing portion to prevent blocking of collected toner.

A further object of the present invention is to provide a process cartridge comprising a frame, an image bearing member for bearing a toner image, a cleaning portion provided between an outer wall and the image bearing member and adapted to clean toner on the image bearing member, an inner wall provided between the frame and the cleaning portion, a first opening provided between the frame and the inner wall at an upper part of the process cartridge, and a second opening provided between the frame and the inner wall at a lower part of the process cartridge.

A still further object of the present invention is to provide an image forming apparatus comprising an Image bearing member for bearing a toner image, a transfer portion for transferring the toner image born on the image bearing member onto a recording material, a fixing portion having a heat source and adapted to fix the toner image on the recording material, a cleaning portion for cleaning toner on the image bearing member, a first wall member provided between the fixing portion and the cleaning portion, a second wall member provided between the fixing portion and the cleaning portion and spaced apart from the first wall member, and an air flow path is constituted by the first and second wall members.

A further object of the present invention is to provide an image forming apparatus comprising an image bearing member, an exposure portion for exposing the image bearing member, a toner image forming portion for forming a toner image on the image bearing member, a transfer portion for transferring the toner image onto a recording material, a fixing portion having a heat source, a cleaning portion for cleaning toner on the image bearing member, a first air flow path provided between the cleaning portion and the exposure portion, a second air flow path provided between the fixing portion and the cleaning portion, a cooling means, a first air-flow-amount adjusting valve provided between the cooling means and the first air flow path, and a second air-flow-amount adjusting valve provided between the cooling means and the second air flow path, and the amount of air passing through the first air-flow-amount adjusting valve differs from the amount of air passed through the second air-flow-amount adjusting valve.

The other objects of the present invention will be apparent from the following detailed explanation of the invention.

BRIEF DESCRIPTION OF THE DRAWINGS

FIG. 3A shows a process cartridge in which the holes are formed in a lower face of the inner air flow path at both ends thereof, FIG. 3B shows a process cartridge in which the hole is formed on the entire lower face of the inner air flow path, and FIG. 3C shows a process cartridge in which the holes are formed in both side faces of the inner air flow path.

DETAILED DESCRIPTION OF THE PREFERRED EMBODIMENTS

The present invention will now be explained in connection with an embodiment thereof with reference to the accompanying drawings. (Entire construction of apparatus)

Figure 1:
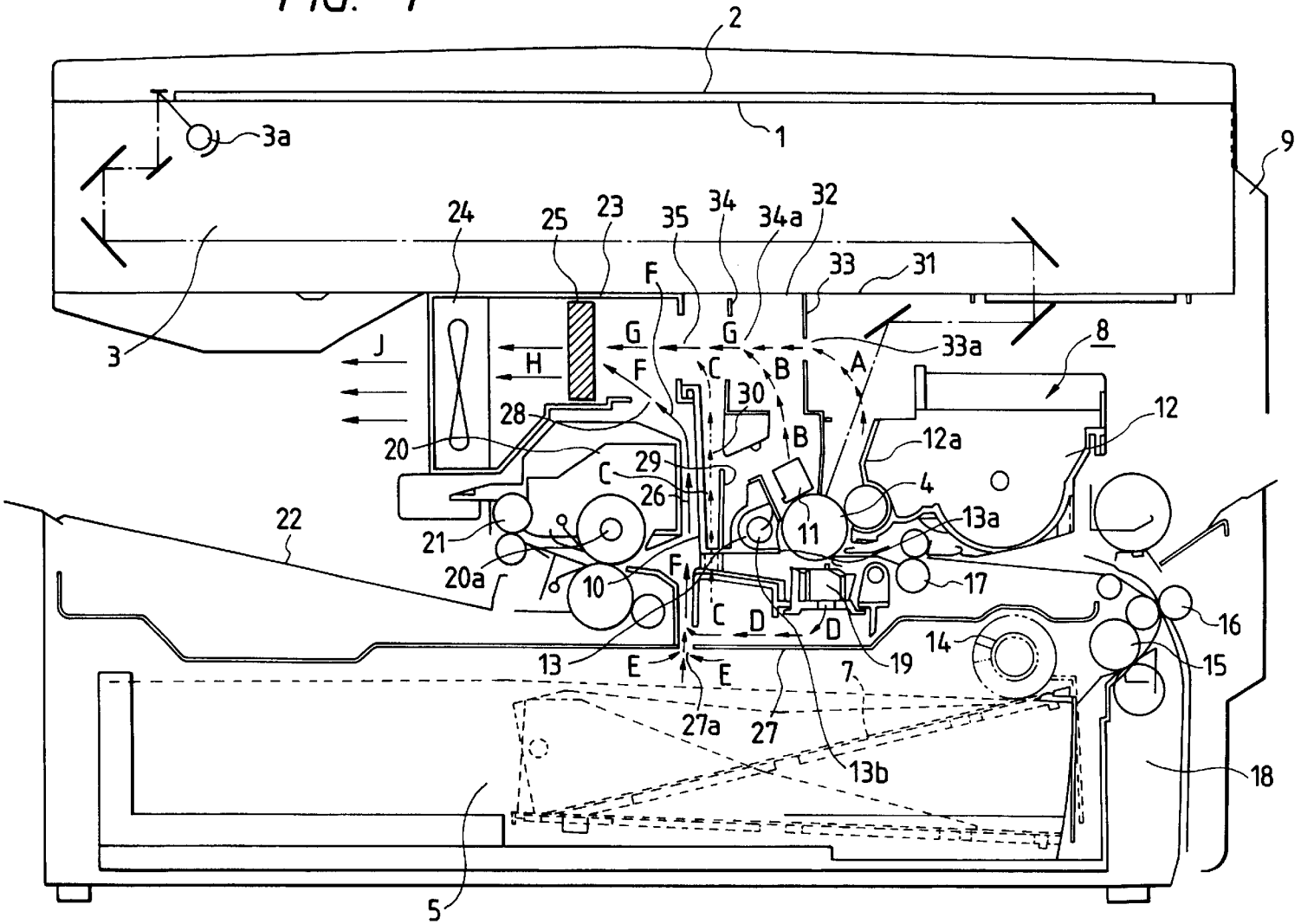
FIG. 1 is a sectional view for explaining an electrophotographic image forming apparatus to which a process cartridge is mounted, according to an embodiment of the present invention.

FIG. 1 is an explanatory sectional view of a copying machine as an example of an image forming apparatus to which a process cartridge is mounted, according to an embodiment of the present invention. In the copying machine, an original 2 set on an original glass 1 is read by an optical exposure means 3, and information light illuminates a photosensitive drum (image bearing member) 4 to form an electrostatic image, and the electrostatic image is developed by toner as a toner image which is in turn transferred onto a recording material 7 conveyed from a cassette 5 by a convey means 18, thereby effecting image formation.

The photosensitive drum 4 is incorporated into a cartridge to constitute a process cartridge 8 which is detachably attachable to a main body 9 of the machine. The process cartridge 8 includes the photosensitive drum 4 and process means acting on the photosensitive drum 4, which are integrally incorporated into a cartridge frame 10 to form a unit. In the illustrated embodiment, as the process means, a primary charger (charge means) 11 for uniformly charging the photosensitive drum 4, a developing means 12 for developing the electrostatic image formed on the photosensitive drum 4 as a toner image, and a cleaning means 13 for removing residual toner remaining on the photosensitive drum 4 after the toner image was transferred to the recording material 7 are integrally provided to form the unit.

The recording materials 7 contained in the cassette 5 are conveyed by the convey means 18 comprised of a feed roller 14, a separation roller 15, a convey roller 16 and registration rollers 17 in synchronism with the image forming operation, the toner image formed on the photosensitive drum 4 is transferred onto the recording material 7 by the action of a transfer charger (transfer means) 19. After the toner image was transferred, the recording material 7 is conveyed to a fixing means 20, where heat and pressure are applied to fix the toner to the recording material 7. Thereafter, the recording material 7 is discharged onto a discharge tray 22 by discharge rollers 21.

Construction of Air Flow Path

In the above-mentioned apparatus, there is provided an air discharge duct 23 above the fixing means 20. Air within the apparatus is discharged toward a direction shown by the arrows H, J by an air discharge fan (cooling means) 24 provided in the air discharge duct 23, thereby cooling the temperature within the apparatus and removing ozone by using an ozone filter 25.

The temperature within the apparatus is increased by heat sources including a heater (heat source) 20*a* of the fixing means 20, and an illumination lamp (light generating portion) 3*a* of the optical exposure means 3. The toner (both fresh toner in the developing means 12 and waste toner collected by the cleaning means 13) is apt to be influenced by the increased temperature. Accordingly, at areas in which a developing blade 12*a* and a cleaning blade 13*a* for scraping the toner and a convey screw 13*b* for conveying the collected waste toner are located, it is required to suppress the increase in temperature. Particularly, when the apparatus is made compact, since the fixing means 20 and the process cartridge 8 approach each other, it is required that heat be discharged by passing the air within the apparatus.

To this end, in the illustrated embodiment, a first air flow path 26 is formed between the fixing means 20 and the process cartridge 8 to suck the air from the transfer charger 19 toward a direction shown by the arrows D and to such air from a direction shown by the arrows E through a hole 27*a* formed in a bottom plate 27 disposed above the cassette 5 so that the airs are mixed to form an air flow passing through the first air flow path 26 and directed toward a direction shown by the arrows F. The air flow flows into the air discharge duct 23 through a first flow-in valve 28 disposed at the entrance of the air discharge duct 23.

Figure 2:
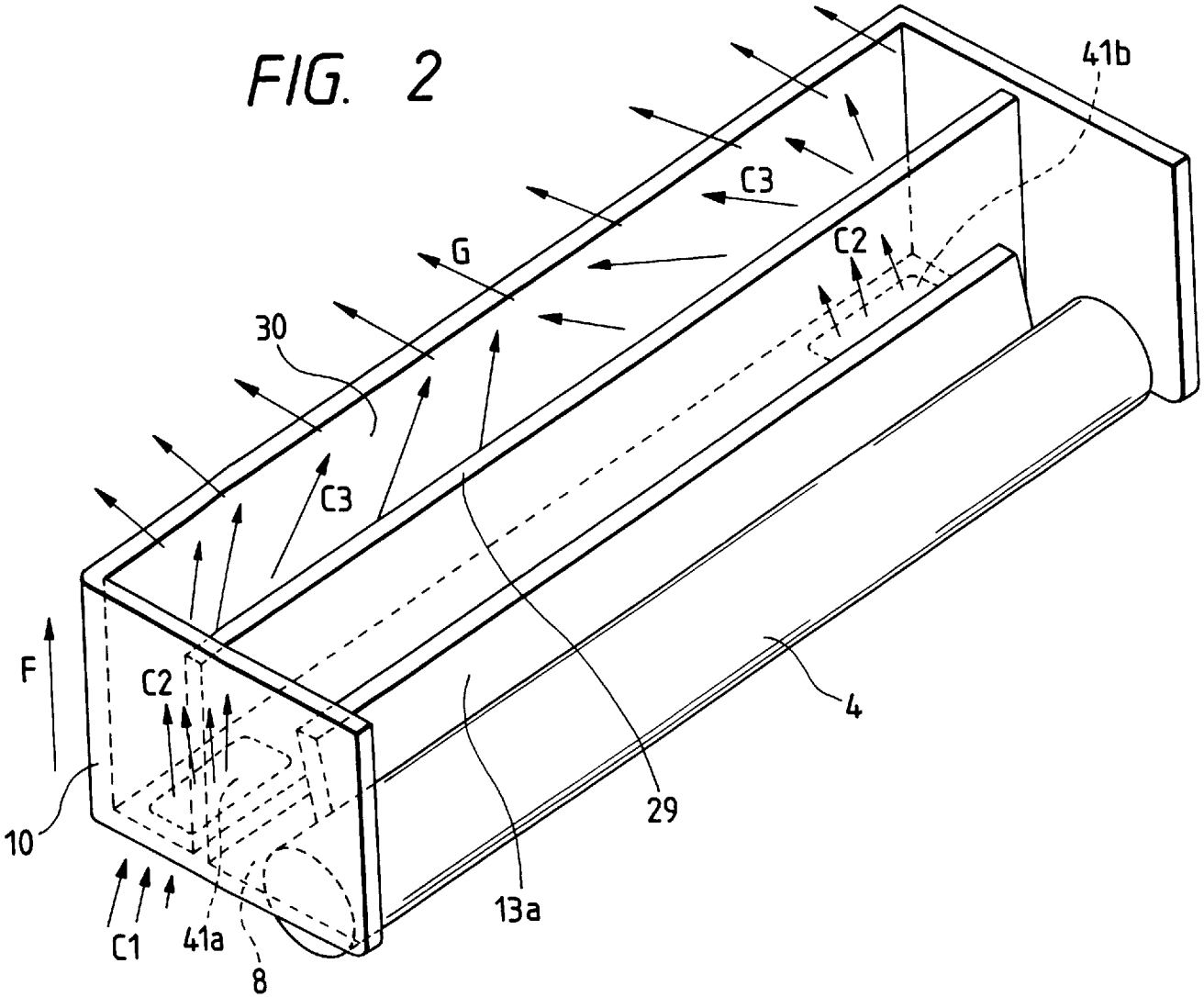
FIG. 2 is a perspective view for explaining air flow-in holes and an air flow path formed in the process cartridge.

Now, the process cartridge 8 will be fully described. As shown in FIGS. 1 and 2, in the process cartridge 8, an inner wall 29 is formed between the cleaning means 13 and the cartridge frame 10 to define an inner air flow path 30. That is to say, the inner air flow path is defined by the inner wall and the frame (wall member opposed to the inner wall). A part of air flowing toward the direction D or air flowing toward a direction C through holes 41*a*, 41*b* formed in the bottom of the frame of the process cartridge 8 flows into the inner air flow path 30 and then flows into the air discharge duct 23.

As shown in FIG. 2, the holes (air flow-in openings) 41*a*, 41*b* are formed in a lower face of the inner air flow path 30 at both ends thereof in a non-sheet pass area, so that air flow into the holes 41*a*, 41*b* from directions shown by the arrows C1 and flow from the directions C2 toward directions shown by the arrows C3 to be mixed together, and the mixed air flow flows toward a direction shown by the arrows G into the air flow path. That is to say, the air within a lower part of the process cartridge flows toward an upper part of the process cartridge through the inner air flow path and is mixed with the air in the air flow path directing toward the direction G. FIG. 3A shows top and side sectional views showing such air flow paths. Incidentally, as is apparent from the drawings, an opening open along the longitudinal direction of the photosensitive drum 4 is formed at an upper part between the inner wall and the frame of the process cartridge, i.e., at a downstream side of the inner air flow path.

Figure 3C:
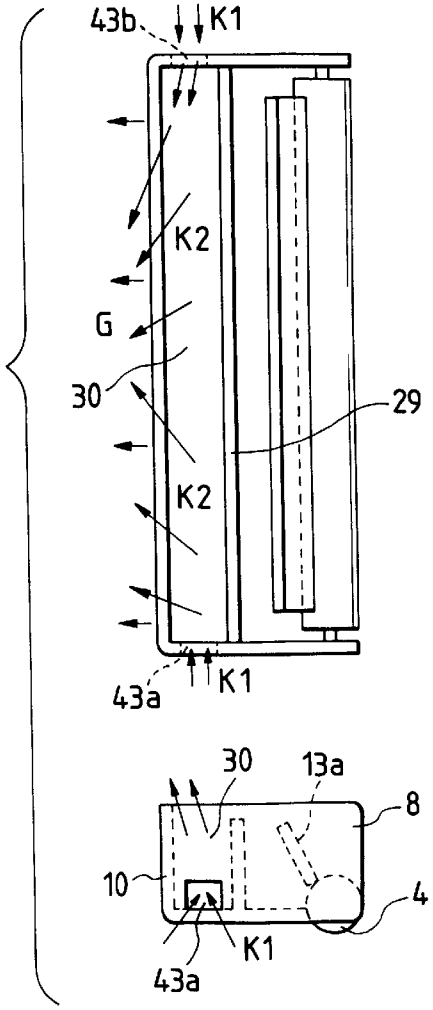
FIGS. 3A, 3B and 3C are top and side sectional views showing the air flow-in hole(s) and the air flow path formed in the process cartridge, where
Figure 3B:
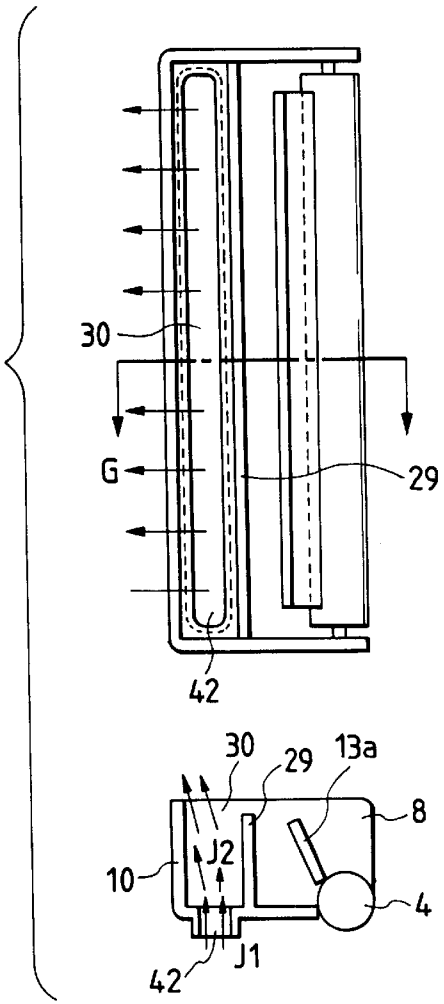
Figure 3A:
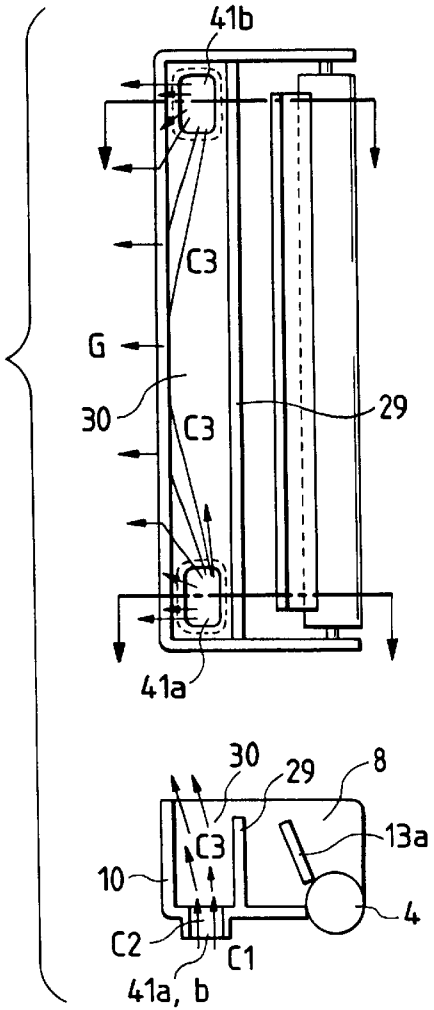
Figure 4:
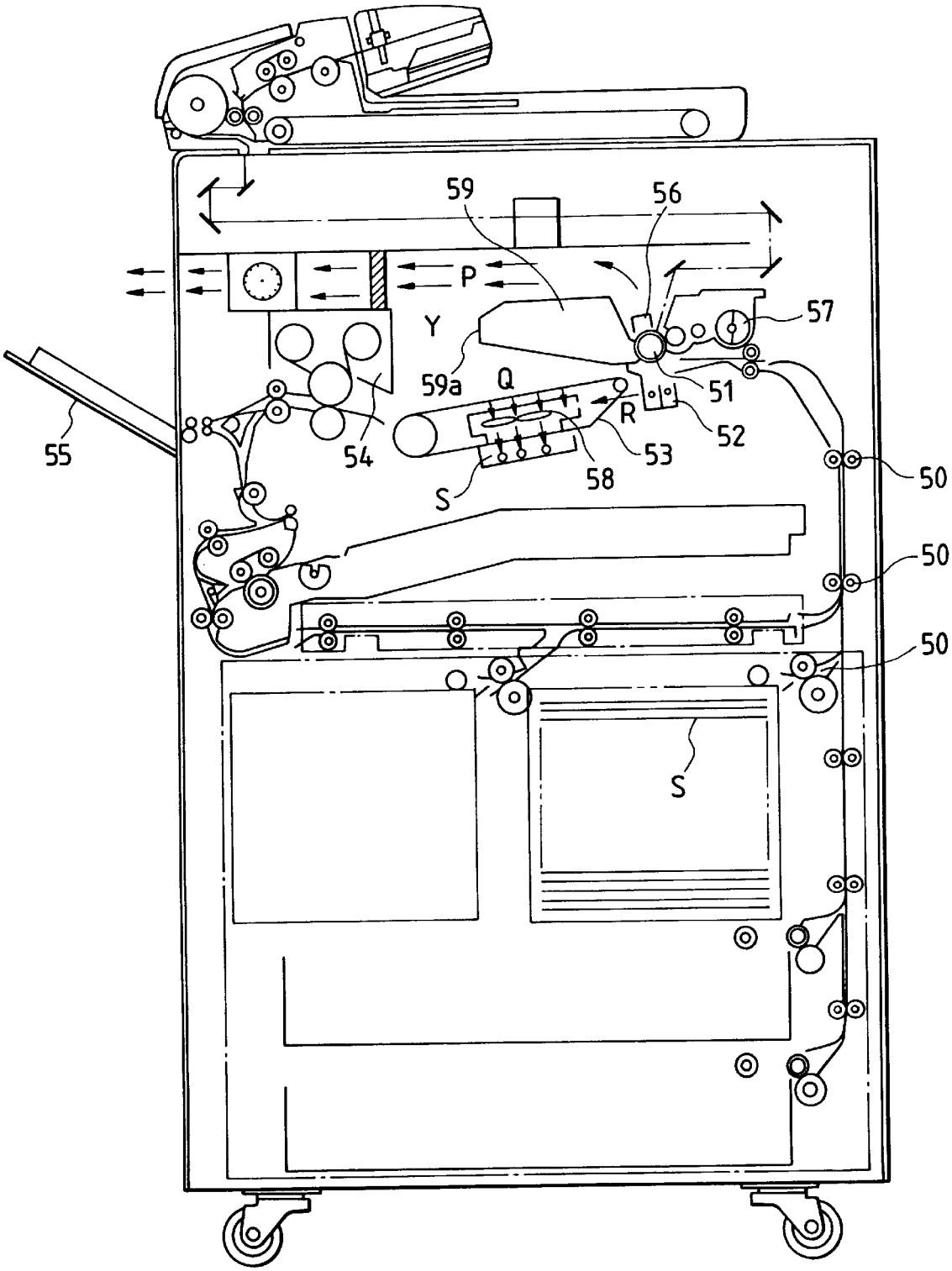
FIG. 4 is an explanatory view for explaining air flow paths in a conventional electrophotographic image forming apparatus.

The positions of the air flow path for flowing-in the air into the process cartridge 8 and the flow-in holes are not limited to the above-mentioned arrangement, but, for example, arrangements as shown in FIGS. 3B and 3C may be adopted. FIG. 3B shows an arrangement in which a hole 42 is formed in the entire lower face of the inner air flow path 30 of the process cartridge 8. In this case, the air flows from a direction shown by the arrows J1 through the hole 42 and flows toward a direction shown by the arrows J2 and then toward the direction G. On the other hand, FIG. 3C shows an arrangement in which holes 43*a*, 43*b* are formed in both side walls of the inner air flow path 30 of the process cartridge 8. In this case, the air flows from the directions shown by the arrows K1 through the holes 43*a*, 43*b* and flows toward the directions shown by the arrows K2 and then toward the direction G.

On the other hand, as shown in FIG. 1, a second air flow path 32 is defined between the process cartridge 8 and a frame 31 of the optical exposure means 3 to effect thermal insulation and cooling. More specifically, air in the vicinity of the developing blade 12*a* is sucked toward a direction shown by the arrows A through a valve 33*a* provided on a wall 33 and then flows toward the direction G to reach the air discharge duct 23. Further, ozone generated in the primary charger 11 and air in the vicinity of the cleaning blade 13*a* flow toward a direction shown by the arrows B through a valve 34a provided on a wall 34 and then flow into the air discharge duct 23 through a second flow-in valve 35 provided at the entrance of the air discharge duct 23.

The valves 33*a*, 34*a* determine the air flow amount in the directions A and B. Further, flow amounts of air in the first and second air flow paths 26, 32 are determined by the first and second flow-in valves 28, 35, and, by adjusting these valves, the air flow amounts can be adjusted. Incidentally, in the illustrated embodiment, it is designed so that the flow amount of the first air flow path 26 becomes greater than that of the second air flow path 32, thereby surely suppressing an increase in temperature of the toner collected by the cleaning means 13.

Further, a flow amount of the air flowing in the inner air flow path 30 defined within the process cartridge is small (near zero) and is considerably smaller than the flow amount of the first air flow path 26 out of the cartridge. The reason is that, although the first air flow path 26 has a function of preventing an increased in temperature and cooling the exterior of the cartridge frame 10 of the process cartridge 8, i.e., the exterior of the fixing means including the heat source, the inner air flow path 30 serves to prevent an increase in temperature within the cartridge by cooling the interior of the cartridge frame 10. Mainly, an increase in temperature of the cartridge frame 10 itself is prevented by cooling the exterior of the cartridge frame 10 by the air passing through the first air flow path 26. Even if the temperature of the cartridge frame 10 is increased, the interior of the cartridge frame 10 is cooled by the air passing through the inner air flow path, thereby preventing transmission of radiant heat from the cartridge frame 10 to the interior of the cartridge. Even if the flow amount of the air flowing through the inner air flow path 30 is zero (non-flowing condition), air serves as a heat insulating layer, thereby suppressing an increase in temperatures of the cleaning blade 13*a* and the convey screw 13*b*.

As mentioned above, by providing the first and second air flow paths 26, 32 within the apparatus and by providing the inner air flow path 30 within the process cartridge, even when the apparatus is made compact, an increase in temperature within the apparatus can be suppressed effectively.

Incidentally, in the above-mentioned embodiment, while an example that the process cartridge 8 having the primary charger 11, developing means 12 and cleaning means 13 as the process means acting on the photosensitive drum 4 is used was explained, so long as a process cartridge, in which at least the cleaning means 13 is provided as the process means and an air flow path is defined between the cleaning means 13 and the cartridge frame, is used, similar to the above-mentioned embodiment, a heat insulating layer is formed between the fixing means 20 and the cleaning means 13, thereby preventing the blocking of the toner collected by the cleaning means 13.

Accordingly, as well as the process cartridge according to the illustrated embodiment in which the photosensitive drum, developing means, charge means and cleaning means are integrally incorporated as the cartridge unit which can detachably be mounted to the main body of the image forming apparatus, for example, the process cartridge may integrally incorporate therein a photosensitive drum, cleaning means and charge means as a cartridge unit which can detachably be mounted to a main body of an image forming apparatus, or may integrally incorporate therein a photosensitive drum, cleaning means and developing means as a cartridge unit which can detachably be mounted to a main body of an image forming apparatus, or may integrally incorporate therein a photosensitive drum and cleaning means as a cartridge unit which can detachably be mounted to a main body of an image forming apparatus. Further, the process cartridge may include a transfer means, as well as the process means. The process cartridge can be mounted and dismounted with respect to the main body of the image forming apparatus by an operator himself, with the result that maintenance of the main body of the image forming apparatus can be effected by the operator himself.

Further, in the above-mentioned illustrated embodiment, when the increase in temperature within the process cartridge can be suppressed sufficiently by the first and second air flow paths 26, 32, the inner air flow path 30 is not necessarily provided in the process cartridge.

In addition, in the above-mentioned illustrated embodiment, while an example that the copying machine was explained and illustrated as the electrophotographic image forming apparatus, the image forming apparatus may be embodied as a printer or a facsimile apparatus.

With the above-mentioned arrangement, in the present invention, the increase in temperature of the outer wall of the cartridge is prevented by insulating the heat of the fixing means to the process cartridge by means of the first air flow path, and the thermal insulation regarding the process means is effectively achieved since the interior of the cartridge is cooled by the inner air flow path within the cartridge. Thus, even when the apparatus is made compact so that the fixing means and the process cartridge approach each other, the image formation can be performed without the deleterious influence of heat.

Further, when the second air flow path is provided between the process cartridge and the optical exposure means, the influence of heat of the optical exposure means upon the process cartridge can be suppressed by the second air flow path, and, by adjusting the air flow amounts of the first and second air flow paths by the valves, the degree of freedom of design of the apparatus can be increased.

Furthermore, by constituting the process cartridge to provide the air flow path between the cleaning means and the cartridge frame, even when the process cartridge is mounted to the main body of the apparatus in the vicinity of the fixing means, the image formation can be effected without the deleterious influence of the heat.

While the present invention was explained with respect to the specific embodiment thereof, the present invention is not limited to such an embodiment, but various alterations can be made within the scope of the invention.

What is claimed is:

1. An image forming apparatus comprising:

an image bearing member for bearing a toner image;

a transfer portion for transferring the toner image on said image bearing member onto a recording material;

a fixing portion having a heat source for fixing the toner image on the recording material;

a cleaning portion for cleaning toner on said image bearing member;

a first wall member provided between said fixing portion and said cleaning portion; and a second wall member provided between said fixing portion and said cleaning potion and spaced apart from said first wall member;

wherein an air flow path is constituted by said first wall member and said second wall member, wherein a fixing side air flow path different from said air flow path constituted by said first and said second wall members is provided between said fixing portion and said first wall member, and the amount of air flowing in said fixing side air flow path is greater than the amount of air flowing in said air flow path constituted by said first and said second wall members.

2. An image forming apparatus according to claim 1, wherein said first wall member is spaced apart from said fixing portion and constitutes an outer wall of a unit having said cleaning portion.

3. An image forming apparatus according to claim 1, wherein said second wall member constitutes an inner wall provided in a unit having said cleaning portion.

4. An image forming apparatus according to claim 1, wherein said first and second wall members are provided on a unit having said cleaning portion, and openings are formed at upper and lower parts of said unit, said openings being provided between said first and second wall members.

5. An image forming apparatus according to claim 1, wherein a cooling means for cooling interior of said image forming apparatus is provided above said air flow path constituted by said first and second wall members.

6. An image forming apparatus according to claim 5, wherein said cooling means comprises a fan.

7. An image forming apparatus according to claim 1, wherein said image bearing member comprises a photosensitive member.

8. A process cartridge detachably mountable to an image forming apparatus, wherein said image forming apparatus has fixing means for fixing a toner image, which is transferred from a photosensitive member to a recording material by using heat, a cartridge mounting portion on which said process cartridge is detachably mountable, a main body air flow path provided between said fixing means and said cartridge mounting portion, and a fan for creating an air flow through said main body air flow path, said process cartridge comprising:

said photosensitive member;

process means for acting on said photosensitive member;

a frame;

a cartridge air flow path to be disposed opposite to said main body air flow path, when said process cartridge is mounted on said cartridge mounting portion, wherein an air flow created by said fan passes through said cartridge air flow path when said process cartridge is mounted on said cartridge mounting portion;

a first opening provided in said frame for exhausting the air flow passing through said cartridge air flow path; and a second opening provided in said frame for receiving the air flow entering said cartridge air flow path.

9. A process cartridge according to claim 8, wherein said process cartridge has a cleaning portion as said process means, said cleaning portion being disposed between said photosensitive member and said frame, said cartridge air flow path being disposed between said cleaning portion and said frame, wherein said cleaning portion removes toner adhering to said photosensitive member.

10. A process cartridge according to claim 8 or 9, wherein, when said process cartridge is mounted on said cartridge mounting portion, said first opening is provided in an upper portion of said frame and said second opening is provided in a lower portion of said frame.

11. A process cartridge according to claim 8, wherein said process means includes at least one of a charging member for charging said photosensitive member, a developing member for developing an electrostatic latent image formed on said photosensitive member and a cleaning member for removing toner adhering to said photosensitive member.

12. A process cartridge according to claim 8 or 9, wherein the amount of air flowing in said cartridge air flow path is smaller than the amount of air flowing in said main body air flow path.

13. A process cartridge according to claim 8 and 9, wherein the direction of the air flow through said cartridge air flow path is the same as the direction of the air flow through said main body air flow path.

14. An image forming apparatus to which a process cartridge is detachably mountable for recording an image on a recording material, said image forming apparatus comprising:

(a) transferring means for transferring a toner image formed on a photosensitive member onto the recording material;

(b) fixing means for fixing the toner image, which is transferred to the recording material, to the recording material by using heat;

(c) a cartridge mounting portion on which said process cartridge is detachably mountable;

(d) a main body air flow path provided between said fixing means and said cartridge mounting portion; and (e) a fan for creating an air flow through said main body air flow path; wherein said process cartridge comprises:

said photosensitive member;

process means for acting on said photosensitive member;

a frame;

a cartridge air flow path to be disposed opposite to said main body air flow cartridge mounting portion, wherein an air flow created by said fan passes through said cartridge air flow path when said process cartridge is mounted on said cartridge mounting portion;

a first opening provided in said frame for exhausting the air flow passing through said cartridge air flow path; and a second opening provided in said frame for receiving the air flow entering said cartridge air flow path.

15. An image forming apparatus according to claim 14, further comprising:

an exposure optical system for illuminating said photosensitive member with information light in accordance with an original resting on an original stand; and a second main body air flow path provided between said exposure optical system and said cartridge mounting portion, wherein said exposure optical system is disposed in an upper portion of said image forming apparatus.

16. An image forming apparatus according to claim 15, wherein said fan creates an air flow through said second main body air flow path.

17. An image forming apparatus according to claim 14, wherein said cartridge air flow path and said main body air flow path are disposed in a direction intersecting said second main body air flow path.

18. An image forming apparatus according to claim 14, wherein the amount of air flowing in said main body air flow path is greater than the amount of air flowing in said cartridge air flow path.

19. An image forming apparatus according to claim 14, wherein a direction of the air flow through said cartridge air flow path is the same as a direction of the air flow through said main body air flow path.

* * * * *

UNITED STATES PATENT AND TRADEMARK OFFICE

CERTIFICATE OF CORRECTION

PATENT NO. : 6,141,512

DATED : October 31, 2000

INVENTOR(S): TOSHIYUKI NAGANO, ET AL.

It is certified that error appears in the above-identified patent and that said Letters Patent is hereby corrected as shown below:

COLUMN 1:
Line 16, "is" should be deleted.

COLUMN 2:
Line 12, "Image" should read --image--.

COLUMN 4:
Line 21, "from" should read --from the--.

COLUMN 5:
Line 13, "increased" should read --increase--.

Signed and Sealed this

First Day of May, 2001

*Attest:*

Nicholas P. Godici

NICHOLAS P. GODICI

*Attesting Officer*

*Acting Director of the United States Patent and Trademark Office*